United States Patent [19]

Behring

[11] Patent Number: 5,070,926

[45] Date of Patent: Dec. 10, 1991

[54] FOLDING DOOR WITH SEVERAL PAIRS OF PANELS

[75] Inventor: Reinhard Behring, Kirchlengern, Fed. Rep. of Germany

[73] Assignee: Paul Hettich GmbH & Co., Kirchlengern, Fed. Rep. of Germany

[21] Appl. No.: 490,686

[22] PCT Filed: Jun. 13, 1989

[86] PCT No.: PCT/DE89/00385

§ 371 Date: May 25, 1990

§ 102(e) Date: May 25, 1990

[87] PCT Pub. No.: WO90/01099

PCT Pub. Date: Feb. 8, 1990

[30] Foreign Application Priority Data

Jul. 26, 1988 [DE] Fed. Rep. of Germany ..... 3825285

[51] Int. Cl.[5] ..... E05D 15/26

[52] U.S. Cl. ..... 160/199; 160/206

[58] Field of Search ..... 160/199, 196.1, 84.1, 160/206, 201, 186, 213

[56] References Cited

U.S. PATENT DOCUMENTS

| | | | |
|---|---|---|---|
| 3,181,596 | 5/1965 | Winnan et al. | 160/206 |
| 3,361,188 | 1/1968 | Rudnick | 160/206 |
| 3,385,344 | 5/1968 | Andrews | 160/206 |
| 4,598,751 | 7/1986 | Peeters-Weem | 160/84.1 |
| 4,763,712 | 8/1988 | Klaauw | 160/84.1 |
| 4,867,221 | 9/1989 | Dixon et al. | 160/199 X |
| 4,953,611 | 9/1990 | Verstraten | 160/199 |

FOREIGN PATENT DOCUMENTS

| | | |
|---|---|---|
| 1759226 | 6/1971 | Fed. Rep. of Germany . |
| 2506469 | 8/1975 | Fed. Rep. of Germany . |
| 7827705 | 12/1979 | Fed. Rep. of Germany . |
| 3507863 | 11/1986 | Fed. Rep. of Germany . |
| 365860 | 1/1963 | Switzerland . |

*Primary Examiner*—David M. Purol

*Attorney, Agent, or Firm*—Peter K. Kontler

[57] ABSTRACT

A folding door has plural pairs of panels and the panels of each pair are pivotally connected to one another via hinges defining vertical pivot axes. For any two neighboring pairs, a first panel of one pair and an adjacent second panel of the other pair are articulated to a carrier movable along a horizontal guide rail. At least each first panel supports an elongated actuating element having a projecting portion which overlies the adjacent second panel in the closed position of the door. Every carrier supports a two-armed lever which is rotatable on an axis paralleling the pivot axes defined by the hinges. In the closed position of the door, a first arm of each lever, is located in the path which the projecting portion of the respective actuating element follows during opening of the door while the second arm abuts the respective second panel. When one pair of panels is folded in order to open the door, the projecting portion of the corresponding actuating element pushes against the first arm of the associated two-armed lever. This causes the second arm of the lever to push against the second panel of the pair of panels adjoining the folded pair thereby facilitating folding the adjoining pair.

12 Claims, 7 Drawing Sheets

FOLDING DOOR WITH SEVERAL PAIRS OF PANELS

BACKGROUND OF THE INVENTION

The present invention relates to a folding door having plural pairs of panels and in which the panels of each pair are pivotally connected to one another. Respective neighboring pairs of panels are articulated to a common carrier and at least the carrier or carriers are guided along one or more horizontal guide rails.

A problem with folding doors of the type under consideration is that a torque must be exerted on the individual panels when the pairs of panels are to be opened from the closed position. The torque causes the panels to fold out of the closed position about the pivot axis.

During opening, the required torque can usually be applied, by means of a handle, to the first pair of panels which a user intends to open. However, this is no longer possible for subsequent pairs of panels so that an effective opening accessory is desired here.

SUMMARY OF THE INVENTION

It is an object of the present invention to provide a folding door of the type under consideration having an economical and compact opening accessory for the opening of all pairs of panels.

According to the invention, this object is achieved in that a follower is affixed to the panels of at least one pair of panels in the region of the hinge between neighboring pairs of panels and that a two-armed lever pivotable on a pivot axis extending parallel to the hinge axis is secured to the common carrier. One lever arm lies in the range of pivoting of the follower and the other lever arm projects to the region of the panel adjacent to the panel with the follower. Thus, beyond a predetermined angle of rotation of the panel with the follower, a torque acting in the direction of opening is exerted on the neighboring panels via the two-armed lever.

Such a construction constitutes a highly effective opening accessory for the folding of successive pairs of panels without special manipulating techniques by the user. Furthermore, an opening accessory in accordance with the invention is assembled in a simple manner and consists of only a few individual components. Due to the fact that the two-armed lever is pivotable about a pivot axis which is parallel to the hinge axis, the opening accessory of the invention is also extremely compact which is of great importance especially as regards folding doors for cabinets.

BRIEF DESCRIPTION OF THE DRAWINGS

The present invention is described below in detail with reference to the accompanying drawings wherein.

DESCRIPTION OF THE PREFERRED EMBODIMENTS

Figure 1:
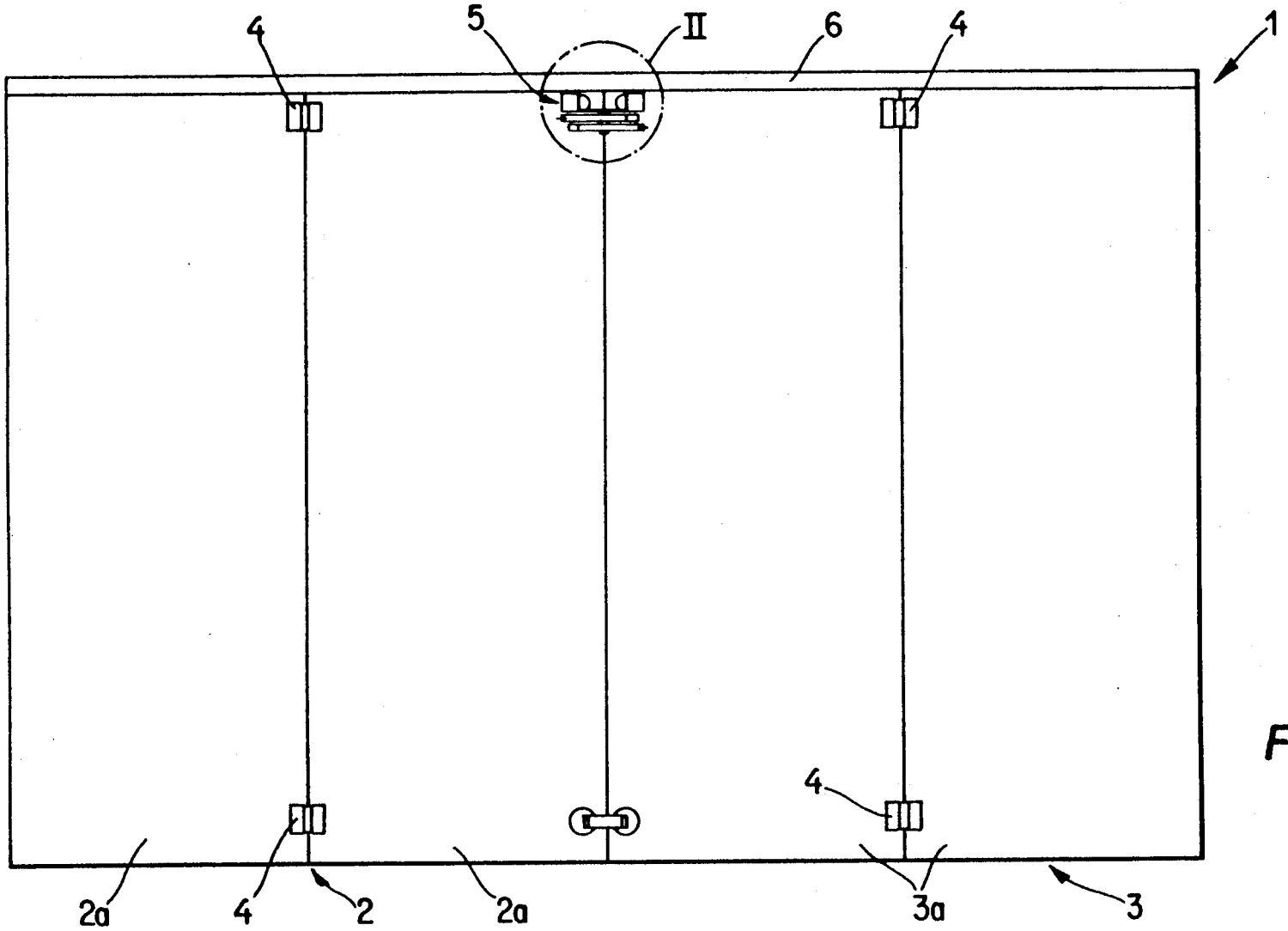
FIG. 1 is a schematic rear view of a folding door with two pairs of panels.

The folding door 1 shown in FIG. 1 has two pairs of panels 2 and 3. The panels 2*a* and 3*a* of each pair of panels 2 and 3 are pivotally connected to one another as indicated by the illustrated hinges 4.

The two neighboring pairs of panels 2 and 3 are articulated to a common carrier 5 which, in known manner, is guided for movement along a horizontal guide rail 6.

Moreover, the respective outer panels 2*a* and 3*a* in FIG. 1 are likewise guided for movement in the guide rail 6.

This means that the folding door 1—as considered in the showing of FIG. 1—can be opened to the left as well as the right.

It is pointed out that the fundamental concept of the present invention is independent of whether the folding door 1 can be opened to both sides or whether one of the end panels 2*a* or 3*a* is fixed with reference to the guide rail 6. In the latter case, the folding door 1 would then open only to the right or only to the left.

The problem which concerns the present invention is that of exerting a torque, which can cause the panels 2*a* and 3*a* to fold from their closed position by rotation about the hinges 4, on the panels 2*a* and 3*a* of both pairs of panels 2 and 3 when the folding door 1 is opened.

For the pair of panels 2 or 3 which is grasped by a user via a non-illustrated handle during opening, a suitable torque is generated by exerting an appropriate push or pull approximately perpendicular to the respective pair of panels 2 or 3.

In the case of the present invention, such a torque is also to be applied, automatically to a certain extent, to the respective following pair of panels 2 or 3, as considered in the direction of opening, so that this pair of panels 2 or 3 is likewise folded out of its closed position.

It will be understood that the identical problem arises for additional pairs of panels and that the same solution can always be used to overcome this problem.

Figure 2:
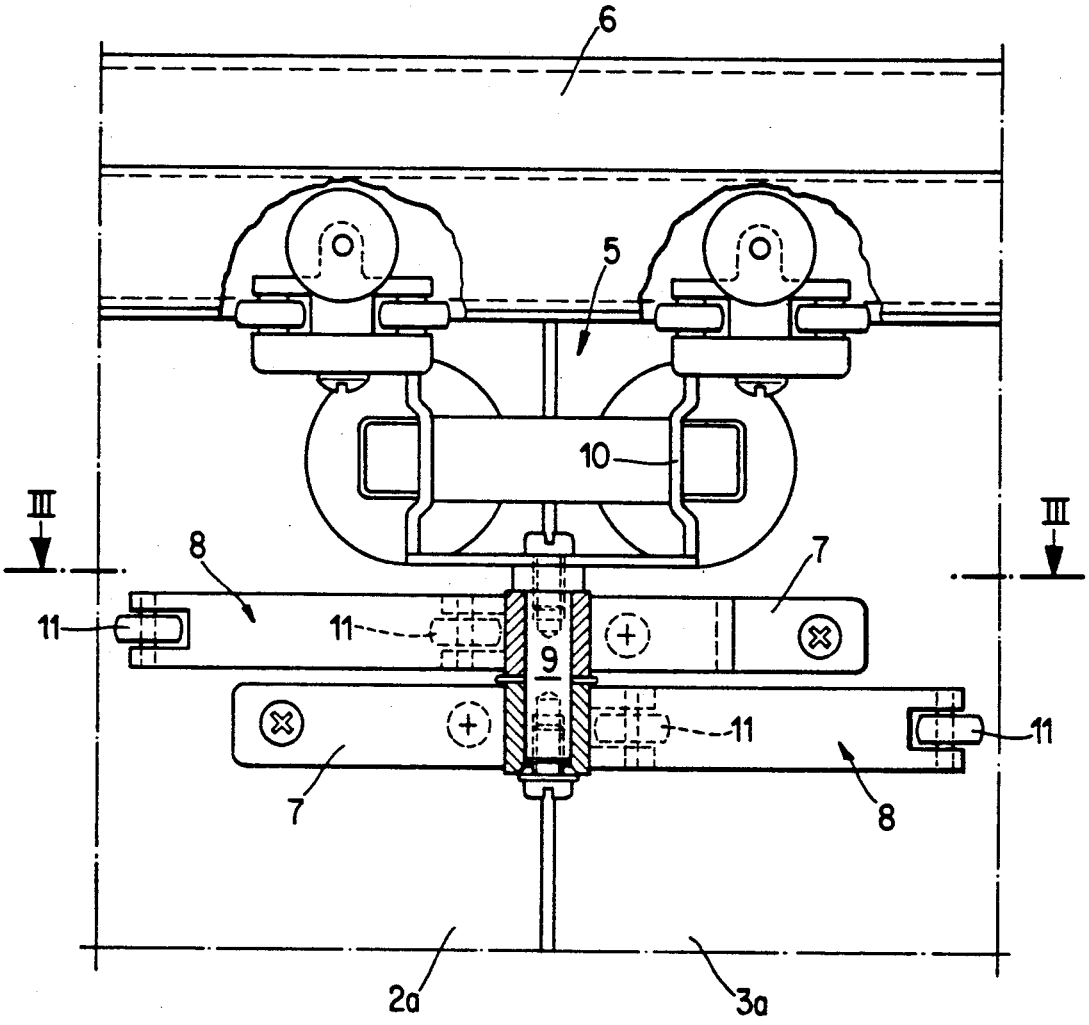
FIG. 2 is an enlarged partly sectional view of the detail indicated at II in FIG. 1.
Figure 3:
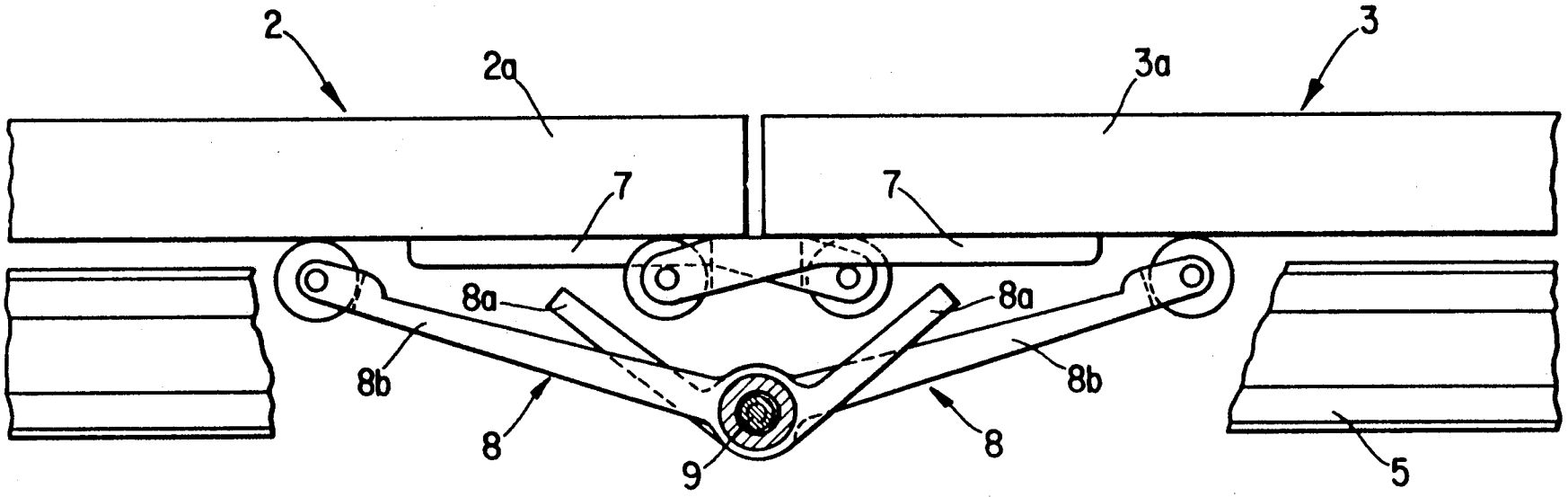
FIG. 3 is a section along the line III—III of FIG. 2.
Figure 4:
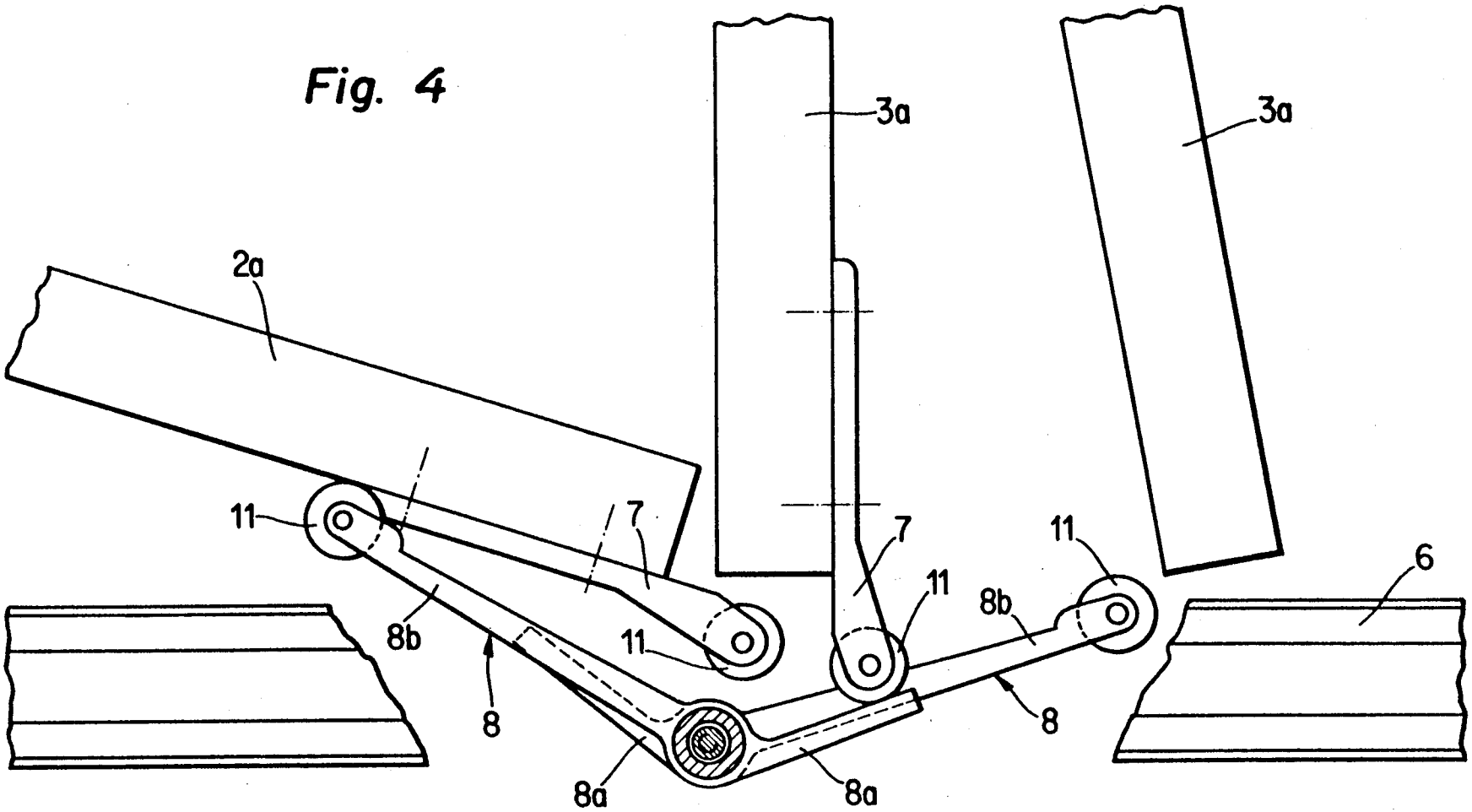
FIG. 4 is a section similar to that of FIG. 3 with the pairs of panels in a partially open position.

As is particularly shown in FIGS. 2 to 4, a follower 7 is secured to each of the panels 2*a* and 3*a* located in the region of the hinge between two neighboring pairs of panels 2 and 3. A pair of two-armed levers 8 is arranged on the common carrier 5 and each is pivotable on a pivot axis 9 extending parallel to the hinge axis. One lever arm 8*a* of each two-armed lever 8 lies in the range of pivoting of the follower 7 of one of the panels 2*a*, 3*a* and the respective other lever arm 8*b* extends to the region of the adjacent panel 2*a*, 3*a*.

It is particularly clear from FIGS. 3 and 4 that, upon opening of a pair of panels—in the illustrated exemplary embodiment the pair of panels 3—the follower 7 secured to the panel 3*a* exerts a torque on the associated two-armed lever 8 when the respective panel 3*a* has pivoted beyond a predetermined range. This is due to the fact that the follower 7 acts on the lever arm 8*a*. The corresponding force is transmitted to the neighboring panel 2*a* via the second lever arm 8*b* where it produces a torque on such panel 2*a*. This results in folding of the following pair of panels 2 thereby facilitating opening of the following pair of panels 2 also.

If, on the other hand, the pair of panels 2 were opened first, the follower 7 secured to the panel 2*a* would then actuate the associated two-armed lever 8 whose lever arm 8*b* would, in this case, abut the neighboring panel 3*a* in a sense to cause folding.

The provision of two followers 7 and two levers 8 is necessary when the folding door—as in the illustrated exemplary embodiment—can be opened to both sides.

In contrast, if a pair of panels 2 or 3 situated at one end is fixed, a single follower 7 and a single lever 8 are sufficient to effect folding of the respective following pair of panels as described above.

FIG. 2 makes it clear that the levers 8 are affixed to the carrier 5 which constitutes a hinge carrier. The carrier 5, which is conventional and therefore not described in detail, is here in the form of an approximately U-shaped bracket 10 which serves as both a hinge carrier and a runner carrier.

Since the two levers 8 are directly secured to this conventional carrier 5 and, in addition, project outward from the associated panels 2*a* and 3*a* to a distance no greater than the carrier 5 itself, the opening accessory for the folding door as described above is extremely compact. This is of great advantage especially when the chamber located behind such a folding door 1 is to be optimally utilized as is the case with a cabinet, for example.

Finally, inasmuch as the opening accessory consists only of simple components, it is also simple and economical to produce.

To facilitate the transmission of motion from the followers to the levers 8, on the one hand, and from the lever arms 8*b* to the panels 2*a* and 3*a*, on the other hand, the followers 7 and lever arms 8*b* are equipped with rollers 11.

In contrast to the exemplary embodiment illustrated in FIGS. 3 and 4, it is, of course, also conceivable to mount the followers 7 and levers 8 in the central region of the panels 2*a* and 3*a*, or even to affix such followers 7 and levers 8 at the upper as well as the lower end portions.

In the final analysis, this depends primarily on the weight of the panels 2*a* and 3*a*.

Figure 5:
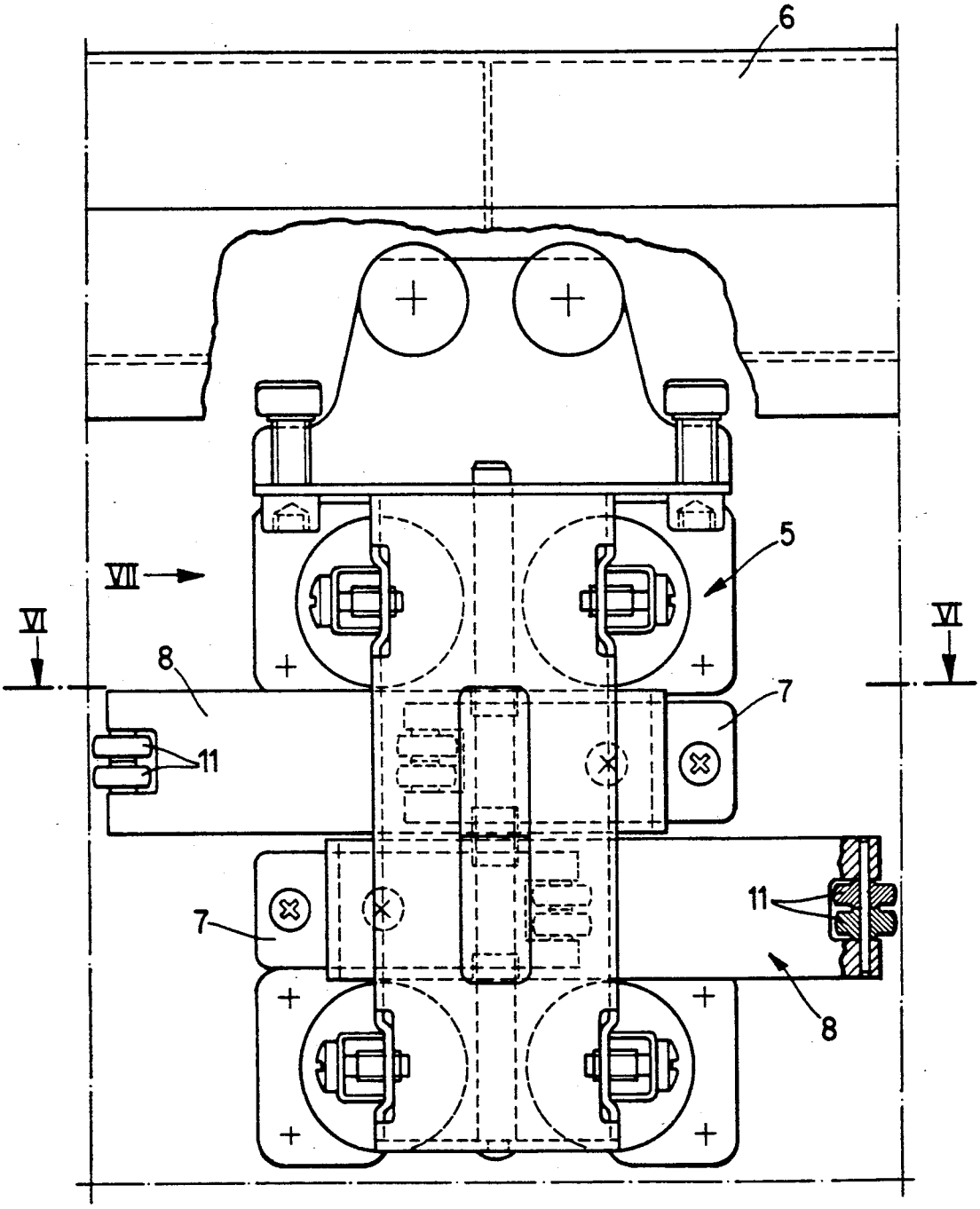
FIG. 5 is a view similar to FIG. 2 of another exemplary embodiment of the invention.
Figure 6:
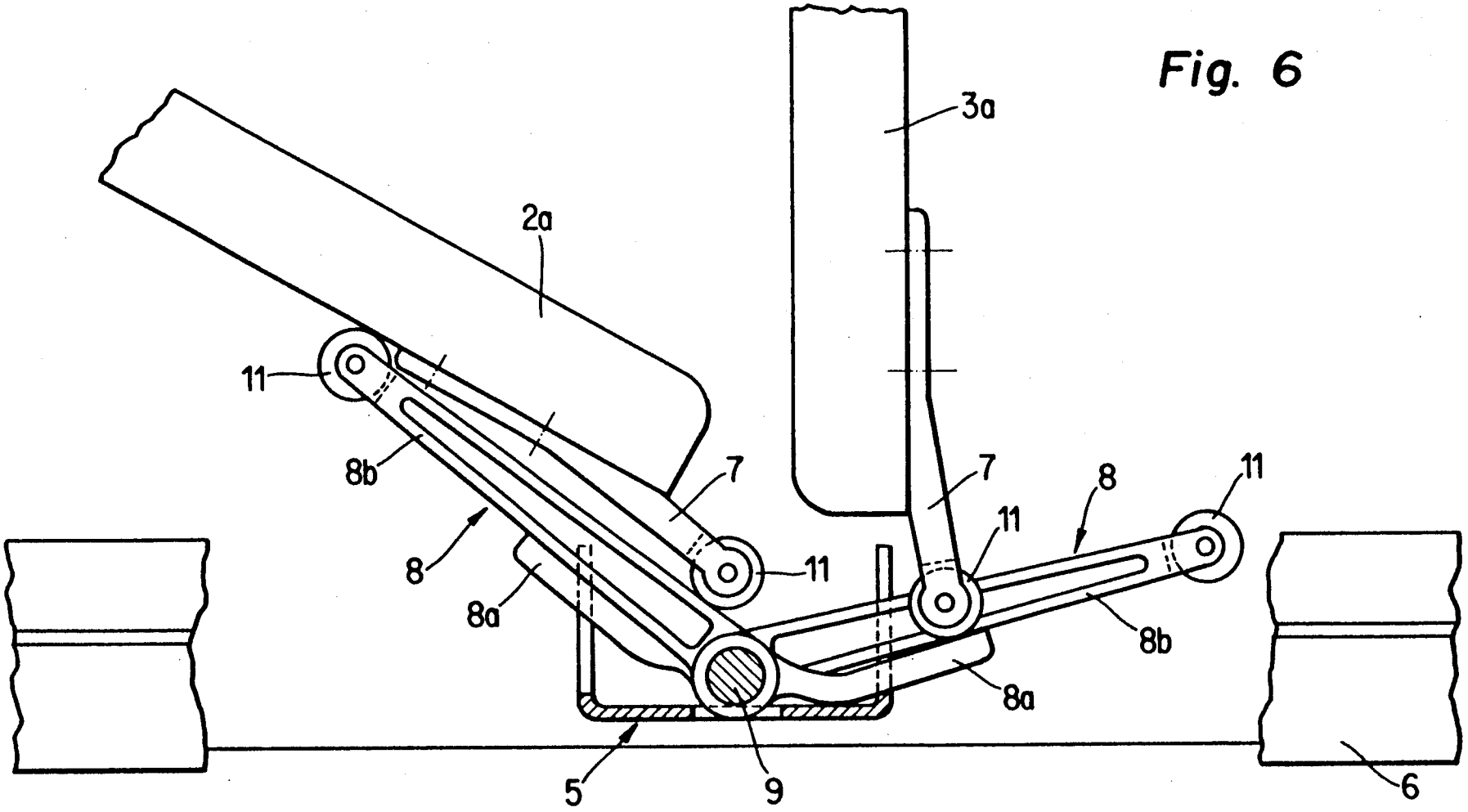
FIG. 6 is a section along the line VI—VI of FIG. 5 with the folding door partially open.
Figure 7:
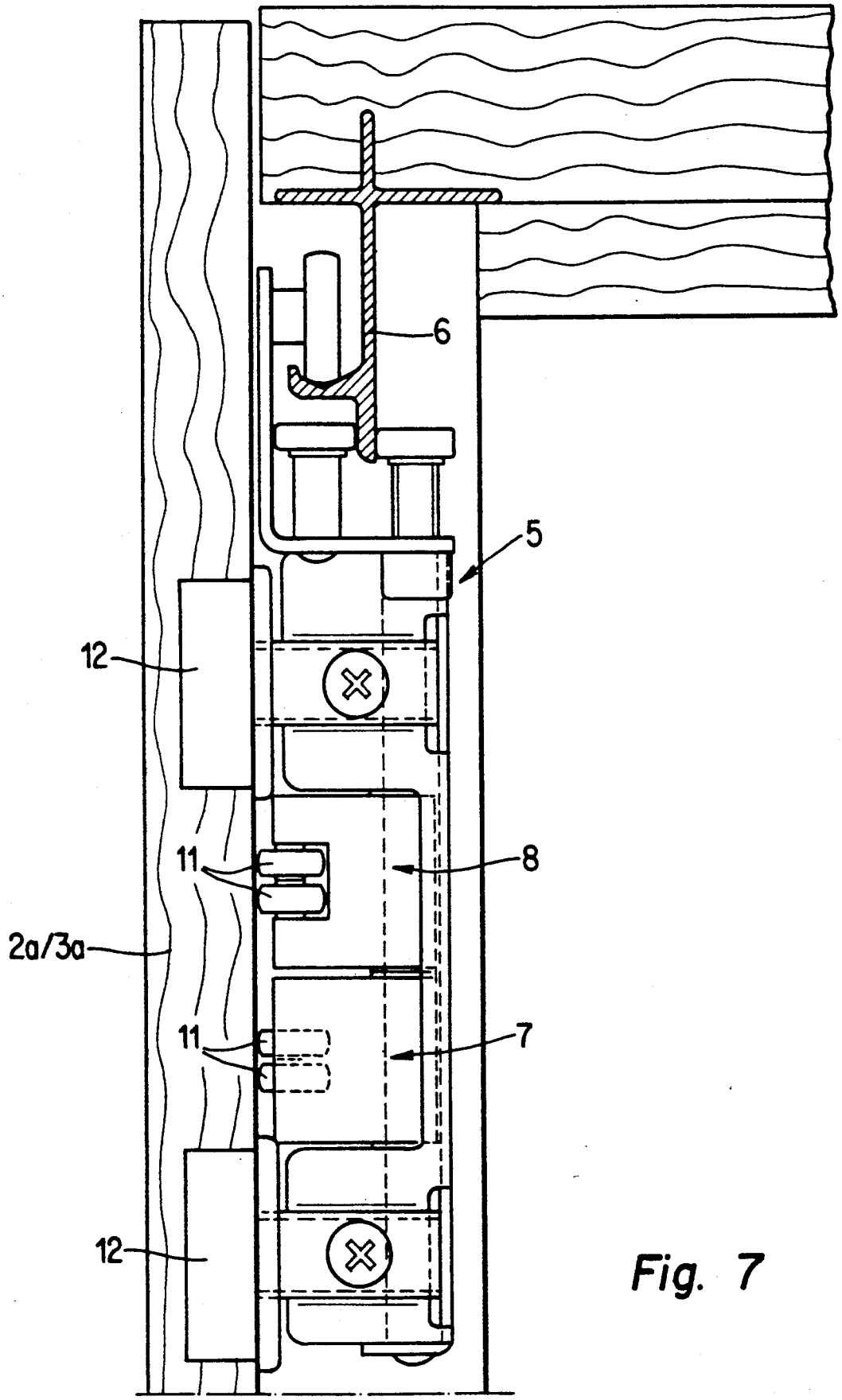
FIG. 7 is a partial elevational view as seen in the direction of the arrow VII of FIG. 5.

FIGS. 5 to 7 make it clear that for carriers 5 in the form of hinge carriers with dual hinges—again, particularly for heavy panels 2*a* and 3*a* —the followers 7 and levers 8 can be compactly arranged in the region between the hinges 12.

If, in conventional fashion, two neighboring pairs of panels 2 and 3 are articulated to continuous strengthening strips, the levers 8 can be mounted in appropriate recesses of these strengthening strips without difficulty.

The application of the follower 7 and the lever 8 is not problematical as regards mounting technique. In particular, it is conceivable to retrofit existing folding doors with such opening accessories.

Both the followers 7 and the levers 8 are advantageously made of plastic. The same applies for the rollers 11.

By appropriate design of the lever 8 and the follower 7, it is possible to establish the opening angle beyond which the desired opening assist is in effect. Similarly, suitable dimensioning of the lever 8 makes it possible to ensure that the torque exerted on the following panel is sufficiently large in relation to the desired opening assist.

I claim:

1. A folding door, comprising a first pair of first panels; first means pivotally connecting said first panels to one another; a second pair of second panels arranged so that one of said second panels is next to one of said first panels; second means pivotally connecting said second panels to one another; and means for exerting a force on said one second panel in response to pivoting of said one first panel so as to pivot said one second panel relative to the other second panel, said exerting means including a first member mounted on said one first panel for pivotal movement therewith along a predetermined path, and a rotary second member having one arm in said path and another arm fast with said one arm and extending to the region of said one second panel, said other arm applying a moment to said one second panel about said second connecting means following entrainment of said one arm by said first member.

2. The door of claim 1, further comprising a guide rail, and a carrier on said guide rail movable along the same said one first panel and one second panel being pivotally connected to said carrier.

3. The door of claim 2, wherein said rotary second member is mounted on said carrier.

4. The door of claim 1, further comprising additional means pivotally connecting said one first panel and one second panel to one another, said additional connecting means defining a pivot axis, and said second member being rotatable about another axis which is substantially parallel to said pivot axis.

5. The door of claim 1, further comprising additional means for exerting a force on said one first panel in response to pivoting of said one second panel so as to pivot said one first panel relative to the other first panel, said additional exerting means including one member mounted on said one second panel for pivotal movement therewith along a preselected path, and another rotary member having a first arm in said preselected path and a second arm fast with said first arm and extending to the region of said one first panel, said second arm applying a moment to said one first panel about said first connecting means following entrainment of said first arm by said one member.

6. The door of claim 1, wherein said first member comprises a roller which is arranged to engage said one arm.

7. The door of claim 1, wherein said other arm comprises a roller which is arranged to engage said one second panel.

8. The door of claim 1, further comprising a guide rail, and a carrier on said guide rail movable along the same, said one first panel and one second panel being pivotally connected to said carrier, and said rotary second member being mounted on said carrier substantially within the confines of the latter, as considered transversely of said panels, when said one arm is free of engagement with said first member.

9. The door of claim 1, further comprising a guide rail, and a carrier on said guide rail movable along the same, said carrier being provided with a pair of hinges for at least one of said panels, and said rotary second member being mounted on said carrier between said hinges.

10. The door of claim 1, wherein said members consist essentially of plastic.

11. The door of claim 10, wherein each of said members comprises a plastic roller.

12. The door of claim 1, wherein said first member has an inoperative position in which said first member is spaced from said one arm so that said first member abuts said one arm only after pivoting of said one first panel through a predetermined angle.

* * * * *